US011386725B2

(12) United States Patent
Guo et al.

(10) Patent No.: US 11,386,725 B2
(45) Date of Patent: Jul. 12, 2022

(54) VEHICLE DIAGNOSTIC APPARATUS

(71) Applicant: Nissan North America, Inc., Franklin, TN (US)

(72) Inventors: Yichao Guo, Rochester Hills, MI (US); Sean Locke, Waterford, MI (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 195 days.

(21) Appl. No.: 16/051,238

(22) Filed: Jul. 31, 2018

(65) Prior Publication Data

US 2020/0043255 A1 Feb. 6, 2020

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01); *G07C 5/0825* (2013.01)

(58) Field of Classification Search
CPC .... G07C 5/0808; G07C 5/008; G07C 5/0825; G07C 2205/02
See application file for complete search history.

(56) References Cited

U.S. PATENT DOCUMENTS 4,208,717 A * 6/1980 Rush ..... B61L 27/0038 701/20
4,553,224 A * 11/1985 Struger ..... G05B 19/054 710/5
4,694,408 A * 9/1987 Zaleski ..... G07C 5/0808 701/32.8
7,317,975 B2 * 1/2008 Woolford ..... G07C 5/008 701/29.3
7,430,261 B2 9/2008 Forest et al.
8,456,327 B2 * 6/2013 Bechtel ..... B60R 1/04 340/435
8,849,104 B2 * 9/2014 Eder ..... B60R 1/00 386/358
9,747,626 B2 * 8/2017 Gormley ..... G07C 5/008
2005/0251705 A1 * 11/2005 Liu ..... G06F 11/3636 714/48
2006/0030981 A1 * 2/2006 Robb ..... G05B 23/0229 701/31.4
2014/0005491 A1 * 1/2014 Huiku ..... A61B 5/7221 600/300

FOREIGN PATENT DOCUMENTS

WO 2007057247 A1 5/2007

* cited by examiner

*Primary Examiner* — Thomas Ingram
*Assistant Examiner* — Omar K Morsy
(74) *Attorney, Agent, or Firm* — Global IP Counselors, LLP

(57) ABSTRACT

A vehicle diagnostic apparatus includes a receiver, an electronic controller and a display. The receiver is configured to receive information from a vehicle monitor. The electronic controller is configured to determine a status of the monitor, and output the status in an 8 bit format based on the information received from the vehicle monitor, at least two of the bits in the 8 bit format indicating a predetermined status of the vehicle monitor. The display is configured to display the output.

10 Claims, 7 Drawing Sheets

VEHICLE DIAGNOSTIC APPARATUS

BACKGROUND

Field of the Invention

The present invention generally relates to a vehicle diagnostic apparatus, more specifically, the present invention relates to a vehicle diagnostic apparatus for improved testing and troubleshooting efficiency for a vehicle monitor.

Background Information

Conventional diagnostic apparatuses use bit mapping to indicate an on-board diagnostic (OBD) monitor enabling status. However, the number of conditions vary per OBD monitors. Some have more than 40 entry conditions, while others may only have 1 or 2. This method is hard to standardize the output for all the monitors.

SUMMARY

It has been discovered that an improved bit mapping apparatus and system is desired to enable standardization for monitors without wasting read only memory (ROM) space.

In view of the state of the known technology, one aspect of the present disclosure is to provide a vehicle diagnostic apparatus comprising a receiver, an electronic controller and a display. The receiver is configured to receive information from a vehicle monitor. The electronic controller is configured to determine a status of the monitor, and output the status in an 8 bit format based on the information received from the vehicle monitor, at least two of the bits in the 8 bit format indicating a predetermined status of the vehicle monitor. The display is configured to display the output.

Another aspect of the present disclosure is to provide a method of diagnosing a vehicle monitor, comprising receiving information, via a receiver, from the vehicle monitor, determining, via an electronic controller, a status of the vehicle monitor, outputting, via the electronic controller, the status in an 8 bit format based on the information received from the vehicle monitor, at least two of the bits in the 8 bit format indicating a predetermined status of the vehicle monitor; and displaying with a display 16 the output.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
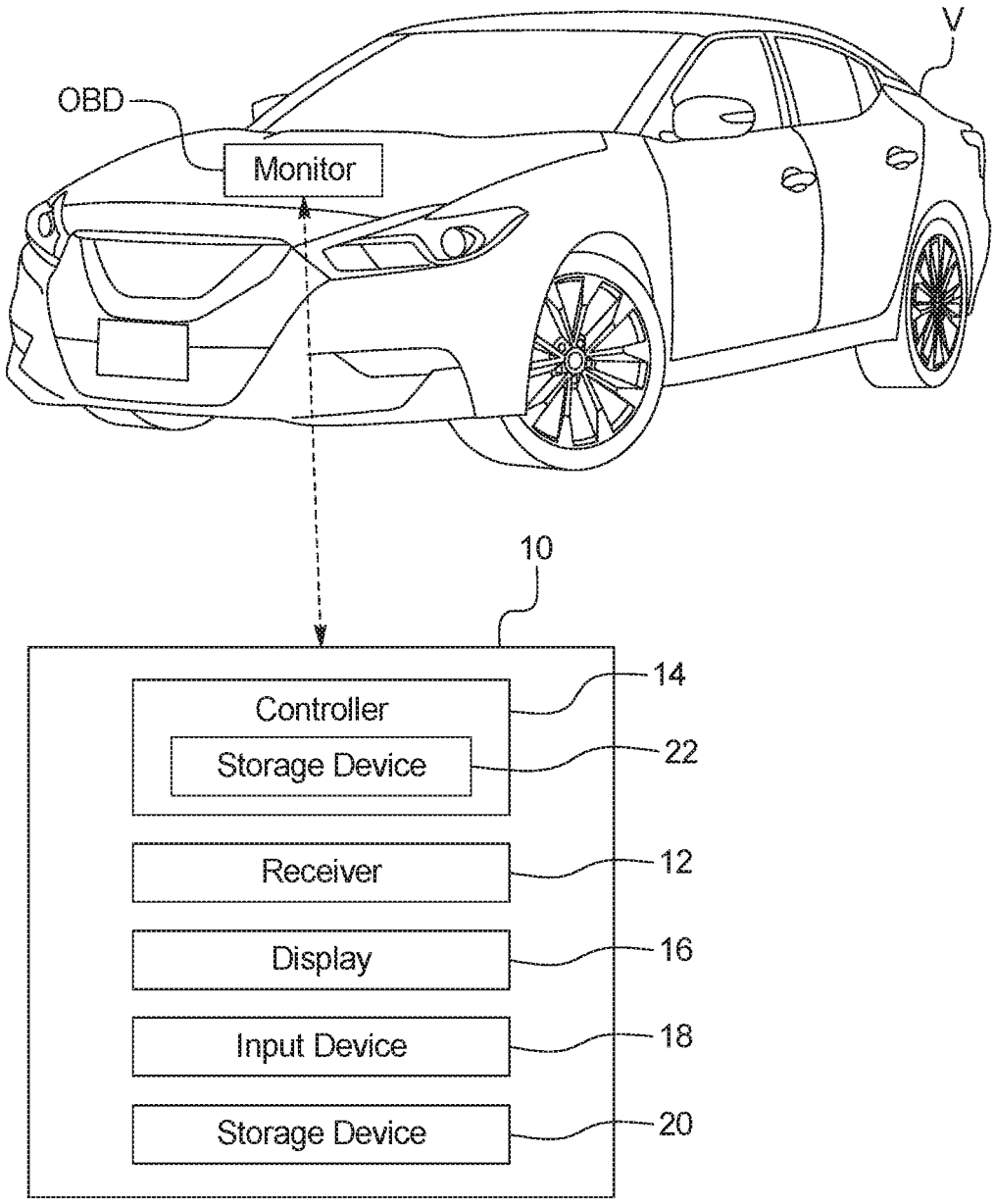
FIG. 1 illustrates a vehicle diagnostic apparatus in accordance with an embodiment of the present invention in communication with a vehicle monitor.

Referring initially to FIG. 1, a vehicle diagnostic apparatus 10 is shown. The vehicle diagnostic apparatus 10, as discussed herein, is a system that is capable of performing real-time evaluation on the execution status of on-board diagnostic monitors (OBD) in a vehicle V. OBD monitoring requirements have become increasingly more stringent and the monitors themselves have become increasingly complex with advancements in regulation requirements, powertrain control system, and management software architecture. The increased complexity of the OBD monitors makes it difficult for a test engineers to validate OBD monitors and for technicians to repair a systems with an OBD faults.

As can be understood, OBD refers to vehicle self-diagnostics and reporting. OBD systems give the vehicle owner or repair technician access to the status of various vehicle subsystems. That is, OBD monitors monitor the status of various vehicle components and provide information relative the component. The component can be any vehicle component such as the engine, the exhaust system, the fuel system or any other system or component within the vehicle V.

The vehicle diagnostic apparatus 10 described herein is capable of performing real-time evaluation on the execution status of on-board diagnostic (OBD) monitors in a vehicle V in light of the increased complexity of the OBD monitors. The vehicle diagnostic apparatus 10 includes a receiver 12, an electronic controller 14, an input device 18, a display 16 and a data storage device 20.

The receiver 12 is configured to receive information from the vehicle monitor OBD. The receiver 12 can be a wireless communication device that is selected from the group of members consisting of: Bluetooth, wireless lan, NFC, zigbee, LTE, UMTS, Z-Wave and infrared, or any other suitable communication means. The wireless communication device is configured to receive data or information from the monitors in the vehicle V. While the receiver 12 preferably receives data or information wirelessly, the receiver 12 can receive data or information when directly wired to the vehicle monitor OBD or through a wired system in communication with the monitor.

The electronic controller 14 is configured to determine a status of the monitor, and output the status in an 8 bit format (or any other format converted form the 8 bit format) based on the information received from the vehicle monitor OBD, at least two of the bits in the 8 bit format can indicate a predetermined status of the vehicle monitor OBD.

The controller 14 is preferably an electronic controller 14. The controller 14 preferably includes a microcomputer having one or more processors with a control program that controls the components of the vehicle diagnostic apparatus 10 as discussed below. The controller 14 includes other conventional components such as an input interface circuit, an output interface circuit, and a storage device 22 (or devices) such as a ROM (Read Only Memory) device and a RAM (Random Access Memory) device. The microcomputer of the controller 14 is at least programmed to carry out diagnostics in accordance with the flow chart of FIG. 2 as discussed below. It will be apparent to those skilled in the art from this disclosure that the precise structure and algorithms for the controller 14 can be any combination of hardware and software that will carry out the functions of the present invention. Furthermore, the controller 14 can communicate with the other components of the vehicle diagnostic apparatus 10 discussed herein via, for example, a control area network (CAN) bus or in any other suitable manner as understood in the art.

The controller 14 is operatively coupled to the receiver 12, the display 16, and the other types of components in the apparatus in any suitable manner as understood in the art, and is programmed to monitor and control these components as discussed herein. The data storage can also store processing results and control programs that are run by the controller 14, such as processing results and control programs for the receiver 12 and the display 16, and any other suitable information.

The data storage device 20 is a computer memory device (i.e., a nonvolatile memory device) can store system data, as well as any other suitable data. Furthermore, the data storage device 20 can store other types of data, such as data pertaining to the monitors. The data storage device 20 permits a read-out operation of reading out data held in the storage medium in response to an instruction from the controller 14 to, for example, determine vehicle component status. The information in the data storage device 20 can also be updated by the controller 14 in any suitable manner as discussed herein and as understood in the art.

The input device 18 can be any suitable input device, and is in electrical communication with the controller 14. For example, the input device 18 can be a keyboard that enables a user to input information and commands into the apparatus. The keyboard can be an electronic digital keyboard or a physical keyboard with buttons or keys. Additionally, the input device 18 can be voice commands hand or finger commands or stylus or pen input. The display 16 can be any suitable display that would enable any desired or suitable data to be displayed. For example, the display 16 can be a transparent screen that is configured to display 16 the information input by the user or data received by the receiver 12. The display 16 can display diagnostic results or any suitable information.

Figure 2:
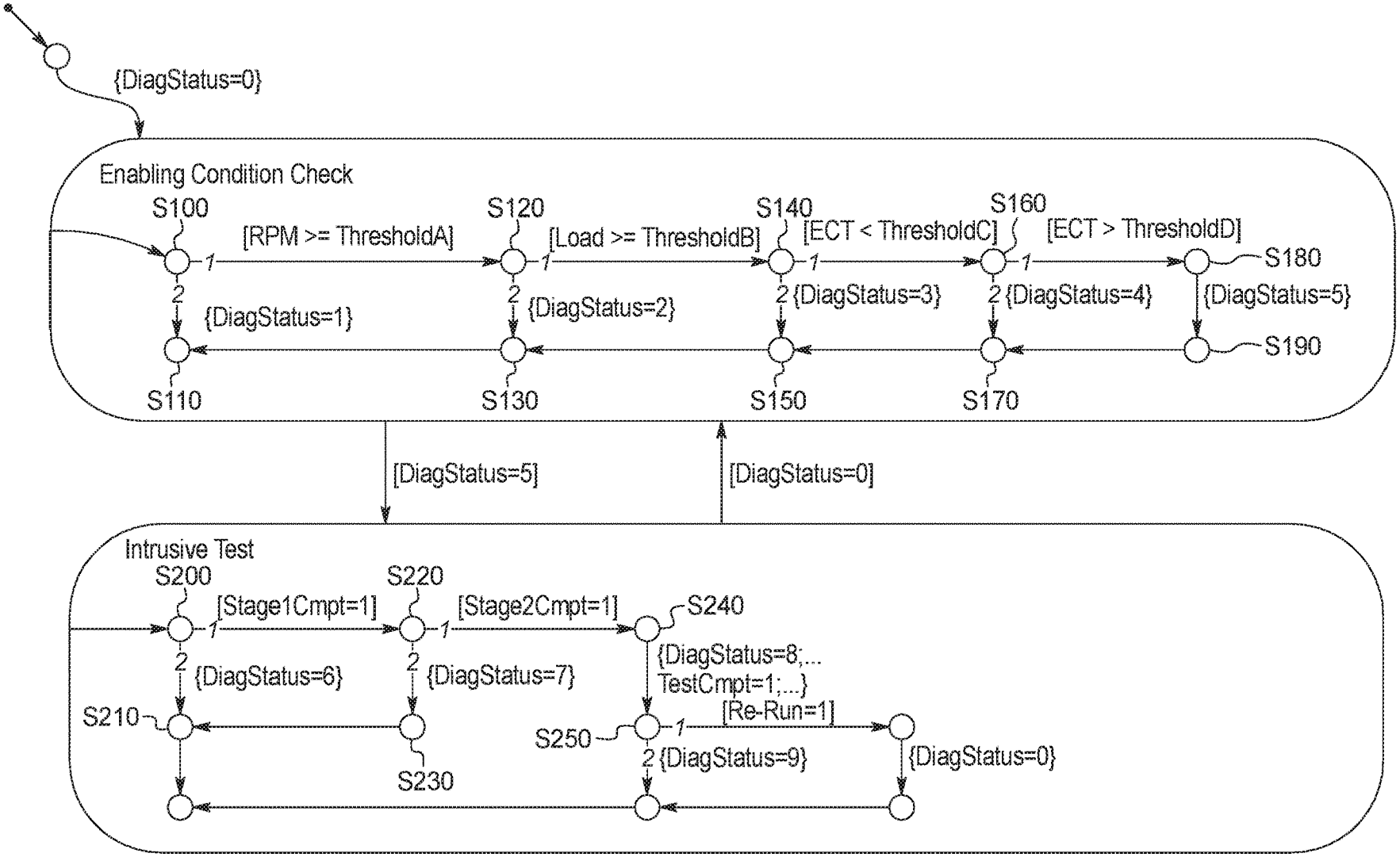
FIG. 2 is a flow chart illustrating one embodiment for the implementation of the vehicle diagnostic apparatus of FIG. 1.

Turning to FIG. 2, an example of the procedure of vehicle monitor OBD diagnostics for the vehicle engine in an enabling condition check is shown. First, the monitor (or monitors) detects engine RPM, engine load and engine coolant temperature (ECT), and/or any other suitable information, and sends a signal including this information to the receiver 12. As previously discussed, this information is received by the receiver 12 wirelessly or through a direct wired connection. That is, the receiver 12 is configured to receive information from the vehicle monitor OBD. In some embodiments, the receiver 12 is configured to receive information from a plurality of vehicle monitors OBD. Also, it is noted that the information does not necessarily need to be sent at the same time and the information can be sent after each determination is performed or based on a request (e.g., a transmission) from the vehicle diagnostic apparatus 10.

Once the information is communicated to the controller 14, the controller 14 determines whether the engine RPMs are greater than or equal to a predetermined threshold A, in step S100. If the engine RPMs are less than the predetermined threshold A, the controller 14 issues a diagnosis status of 1 (0000 0001) in step S110, and terminates the monitor process due to low RPMs. If the engine RPMs are greater than or equal to the predetermined threshold A, the controller 14 determines whether the engine load is greater than or equal to a predetermined threshold B in step S120. If the engine load is less than the predetermined threshold B, the controller 14 issues a diagnosis status of 2 (0000 0010), and terminates the monitor process due to low engine load in step S130. If the engine load is greater than or equal to the predetermined threshold B, the controller 14 determines whether the ECT is less than a predetermined threshold C in step S140. If the ECT is less than the predetermined threshold C, the controller 14 issues a diagnosis status of 3 (0000 0011), and terminates the monitor process due to the current ECT being too low in step S150. If the ECT is greater than the predetermined threshold C, the controller 14 determines whether the engine coolant temperature (ECT) is greater than a predetermined threshold D in step S160. If the ECT is less than the predetermined threshold D, the controller 14 issues a diagnosis status of 4 (0000 0100) in step S170, and terminates the monitor process due to the current ECT being too high in step S170. If the controller 14 determines that the ECT is greater than the predetermined threshold D, the controller 14 issues a diagnosis status of 5 (0000 0101) intrusive test not started in step S190.

As shown in FIG. 1, the process then proceeds to the intrusive test phase. Thus as can be understood, the receiver 12 receives information from the vehicle monitor OBD, including a plurality of enabling conditions, and determines the status of the plurality of enabling conditions, and outputs the status in the 8 bit format. The controller 14 then, based on the plurality of enabling conditions, performs at least one test (and preferably two or more intrusive tests) on the monitor. The information for the stage 1 intrusive tests can be sent from the monitor (and received by the receiver 12) with the initial data information or during real-time updates, as discussed herein. Moreover, the information can be sent based on a request (transmission) from the vehicle diagnostic apparatus 10.

In step S200, the controller 14 determines whether the first stage (stage 1) test is completed. If the first stage test is not completed, the controller 14 in step S210 indicates a diagnosis status of 6 (0000 0110), which indicates that the intrusive test in the first stage is not complete (i.e., the test is in stage 1). If the first stage test is completed, the controller 14 determines whether the second stage (stage 2) test is completed in step S220. If the second stage test is not completed, the controller 14 in step S230 indicates a diagnosis status of 7 (0000 0111), which indicates that the second stage test is not complete (i.e., the test is in stage 2). If the second stage test is completed, the controller 14 indicates a diagnosis status of 8 (0000 1000) in step S240, which indicates that the test is complete. The controller 14 then issues a diagnosis status of 9 (0000 1001) in step S250, which indicates that the test is complete and it is waiting for the re-run conditions to be met. As can be understood, the diagnosis status can be any desired state of a specific monitor and the procedure describe herein is for general exemplary purposes only.

The controller 14 can cause each of these diagnosis status to be displayed on the display. Accordingly, as can be understood, the controller 14 is configured to determine a status of the monitor, and output the status in an 8 bit format based on the information received from the vehicle monitor OBD, at least two of the bits in the 8 bit format indicating a predetermined status of the vehicle monitor OBD. In some embodiments, the controller 14 is configured to determine a status for each of a plurality of vehicle monitors OBD, and output the status for each of the plurality of vehicle monitors OBD in the 8 bit format. Each bit in the 8 bit format corresponds to a predetermined condition of the monitor, and at least one bit (and preferably a plurality) in the 8 bit format corresponds to a predetermined threshold. Moreover, each of these diagnosis statuses for each monitor can be stored in a storage device 20 in the vehicle diagnostic apparatus 10, or remotely in the cloud or other remote storage device. Table 2 below shows the display 16 indicating the monitor status.

TABLE 2

| Status # | U8 Bit Status | Mapped OBD Monitor Status |
|---|---|---|
| 0 | 0000 0000 | Not Enabled/Test Re-run Conditions Met |
| 1 | 0000 0001 | Disabled: Low RPM |
| 2 | 0000 0010 | Disabled: Low Load |
| 3 | 0000 0011 | Disabled: Current ECT Too Low |
| 4 | 0000 0100 | Disabled: Current ECT Too High |
| 5 | 0000 0101 | Intrusive Test Not Started |
| 6 | 0000 0110 | Intrusive Test In Stage 1 |
| 7 | 0000 0111 | Intrusive Test In Stage 2 |
| 9 | 0000 1001 | Test Complete, Waiting for Re-run Conditions to Be Met |

Figure 3:
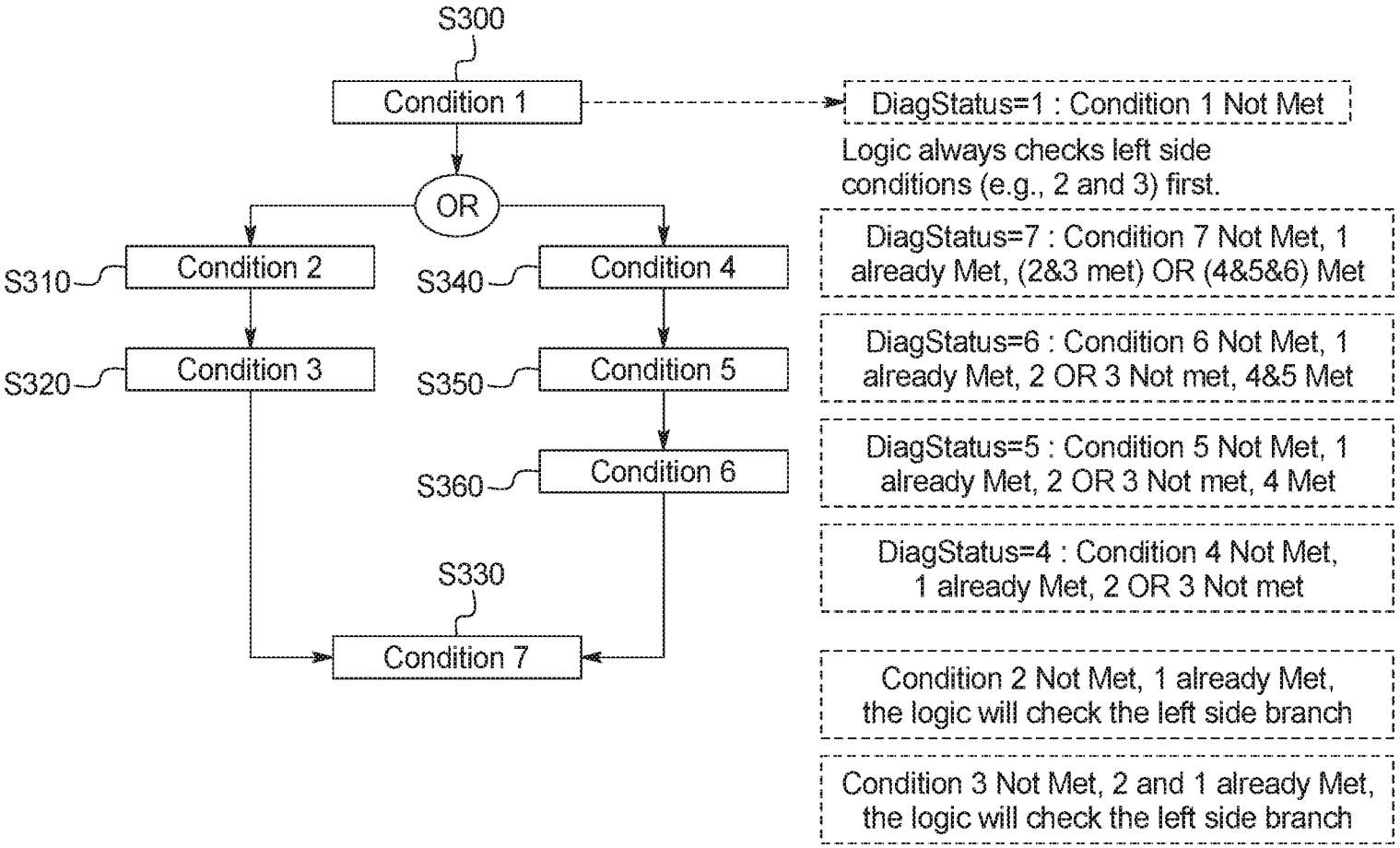
FIG. 3 is a flow chart illustrating single threading for OR conditions in the vehicle diagnostic apparatus of FIG. 1.

FIG. 3 illustrates a single threading concept for OR conditions in OBD monitor executions. After condition 1 is met, the logic can check conditions 2 and 3 or conditions 4 and 5 and 6. If either branch is met, then the system can check condition 7. For single threading, the logic will generally start from the left side branch. If any condition is not met, the logic will try the branch on its right hand side in the same execution loop. Until the logic reaches the rightest branch, and it will output the status if the logic stops at certain condition checks.

Thus, in FIG. 3, first, the monitor (or monitors) detects several conditions of a vehicle system, and sends a signal including this information to the controller 14. As previously discussed, this information is received by the receiver 12 wirelessly or through a direct wired connection. Also, it is noted that the information does not necessarily need to be sent at the same time and the information can be sent after each determination is performed or based on a request (e.g., a transmission) from the vehicle diagnostic apparatus 10. In step S300, the controller 14 determines whether condition 1 is met. If condition 1 is not met, the controller 14 can indicate a diagnosis status of 1 (e.g. 0000 0001). If condition 1 is met, the controller 14 can determine whether condition 2 is met is step S310 and whether condition 3 is met is step S320. If both conditions 2 and 3 are met, the controller 14 can determine whether condition 7 is met is step S330. If condition 7 is not met the controller 14 can indicate that condition 7 is not met, but condition 1 and 2 and 3 have already been met.

If either condition 2 or 3 is not met is steps 310 or 320, the controller 14 can move to the right branch and determine whether condition 4, condition 5 and condition 6 are met is steps S340, S350 and S360 respectively. If condition 4 is not met in step S340, but condition 1 is met and either condition 2 or 3 is not met, the controller 14 can indicate that diagnosis status of 4, the controller 14 can indicate that diagnosis status of 4. If condition 4 is met, but condition 5 is not met in step S350, and thus condition 1 is also met, and either condition 2 or 3 is not met, the controller 14 can indicate that diagnosis status of 5. If condition 5 is met, but condition 6 is not met in step S360, and thus condition 1 is met and condition 4 is met, and either condition 2 or 3 is not met, the controller 14 can indicate that diagnosis status of 6. If condition 6 is met the controller 14 can determine whether condition 7 is met is step S330. If condition 7 is not met the controller 14 can indicate that condition 7 is not met, but condition 1 and 4-6 have already been met.

The controller 14 can cause each of these diagnosis status to be displayed on the display 16. Moreover, each of these diagnosis status can be stored in a storage device 20 in the vehicle diagnostic apparatus 10, or remotely in the cloud or other remote storage device. The single threading procedure is advantages because it is simple for designer, and simple to use.

As is understood, conventional diagnostic devices can output 10 modes as shown in Table 3.

TABLE 3

| Mode | Description |
|---|---|
| 01 | Stream selected data |
| 02 | Show freeze frame data |
| 03 | Show stored Diagnostic Trouble Codes |
| 04 | To clear Diagnostic Trouble Codes (DTCs) and stored values |
| 05 | To show monitor Test results |
| 06 | Test results, other component/system monitoring |
| 07 | To show pending Diagnostic Trouble Codes (detected during current or last driving cycle) |
| 08 | To control operation of on-board component/system |
| 09 | To request vehicle information, including IUMPR |
| 0A | To show permanent Diagnostic Trouble Codes (DTCs) (Cleared DTCs) |

Generally, the modes have a designated usage, and are restricted by ARB requirements. Mode 05 is obsolete, and thus mode 5 can be selected to output diagnostic status. Accordingly, in some embodiments the apparatus can utilize an existing mode 5 to output the Diagnostic Status of OBD monitors. To make this mode suitable for Diagnostic Status display, the apparatus is configured to show the current Diagnostic Status, and data streaming is possible within this mode. To be compatible with most OEMs, the apparatus includes 4096 PIDs (Hex ranges from 0000 to 0FFF), and each PID has a byte to be associated with it. Thus, mode 5 can provide the diagnostic status for up to 4096 monitors.

Table 4 is an example of the scan tool output design.

TABLE 4

| PID (Hex) | Description | Comments | Value (Hex) |
|---|---|---|---|
| 0x0001 | Diagnostic Status of OBD Monitor 1 | 00- Monitor 1 is not configured | 00 |
| 0x0001 | Diagnostic Status of OBD Monitor 2 | 01- Monitor 2 is not enabled | 01 |
| 0x0002 | Diagnostic Status of OBD Monitor 3 | 05- Monitor 2 is enabled | 015 |
| 0x0003 | Diagnostic Status of OBD Monitor 4 | FF- Monitor 3 is completed | FF |
| . . . | | | |
| 0x0FFF | Diagnostic Status of OBD Monitor 4096 | 00- Monitor 1 is not configured | 00 |

Figure 7:
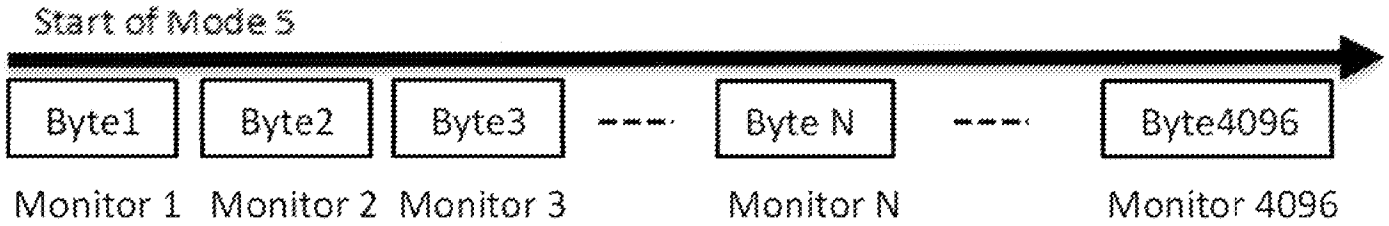
FIG. 7 illustrates the byte assignment of the monitors within Mode 5.

Thus, as can be understood the specification of mode 5 can be slightly modified to fit the needs of Diagnostic Status output. For example, FIG. 7 illustrates the byte assignment of the monitors within Mode 5.

The "Diagnostic Status Summary" Table 5 as follows can be prepared for each monitor that outputs a diagnostic status. Each Table can be provided to test engineers/service technicians.

TABLE 5

| Monitor # | Mode 5 PID # | PID Output | Monitor Status |
|---|---|---|---|
| N + 1 | 000N | 00 | Not Configured |
| | | 01 | Not Enabled |
| | | 02 | Disabled, IAT Too Low |
| | | 03 | Disabled, IAT Too High |
| | | 04 | Disabled, Load Too High |
| | | 05 | Disabled, Vehicle Speed Too Low |
| | | 06 | Enabled, Intrusive Test Not Started |
| | | 07 | Enabled, Intrusive Test In Stage 1 |
| | | 08 | Enabled, Intrusive Test In Stage 2 |
| | | FC | Test Passed, waiting for new tests |
| | | FD | Test Failed, waiting for new tests |
| | | FE | Test Passed, Done for current Driving Cycle |
| | | FF | Test Failed, Done for current Driving Cycle |

Figure 4B:
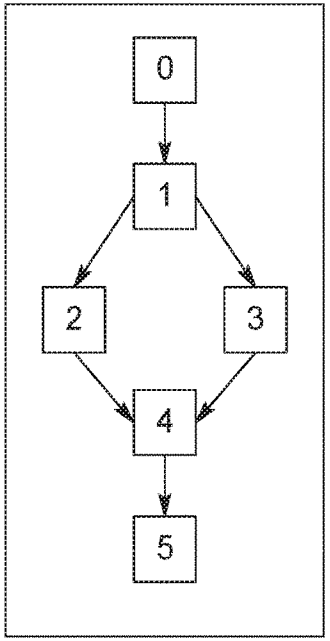
FIGS. 4A and 4B are a flow charts illustrating multi-threading for OR branches in the vehicle diagnostic apparatus of FIG. 1.
Figure 4A:
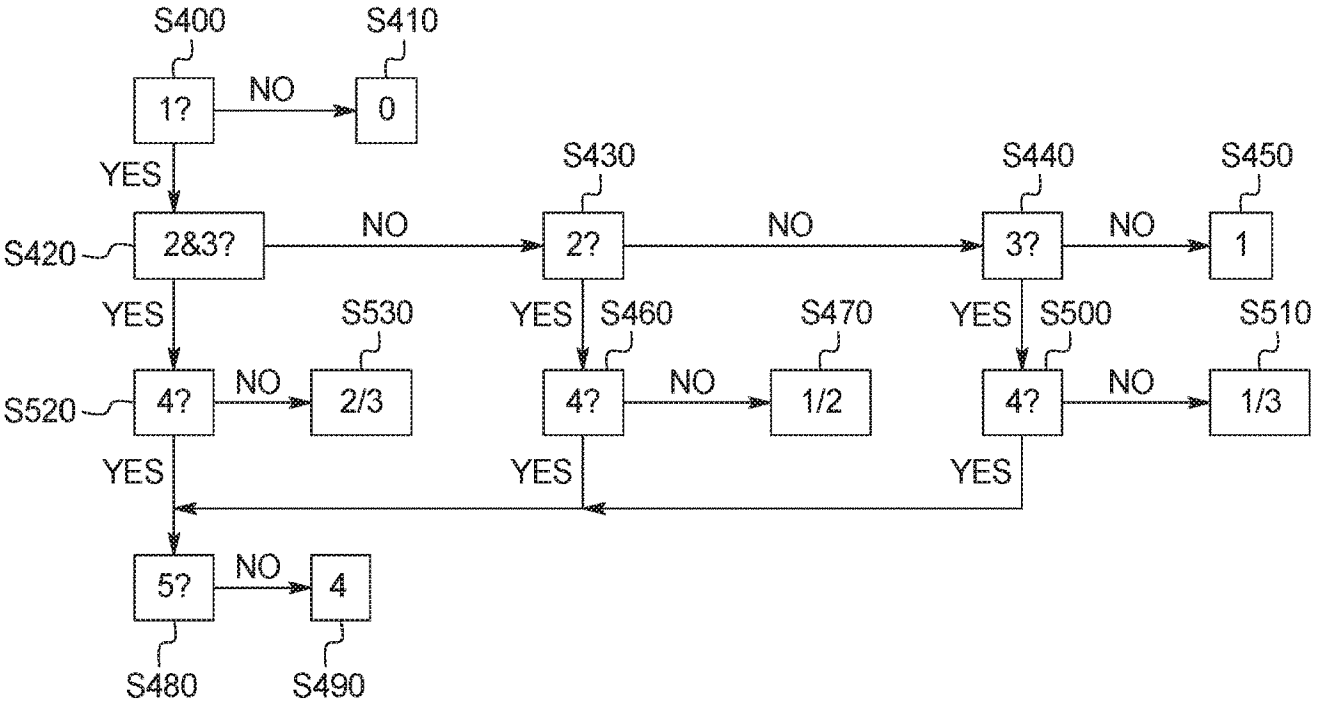

Turning to FIGS. 4A and 4B, the flow charts illustrate a multi-threading embodiment for OR conditions in OBD monitor executions. Similarly to FIG. 3 discussed above, first, the monitor (or monitors) detects conditions of the monitor or monitors, and sends a signal including this information to the controller 14. As previously discussed, this information is received by the receiver 12 wirelessly or through a direct wired connection. Also, it is noted that the information does not necessarily need to be sent at the same time and the information can be sent after each determination is performed or based on a request (e.g., a transmission) from the vehicle diagnostic apparatus 10. Then in step 400, the controller 14 determines if a first condition is met. If the first condition is not met, the procedure can be terminated in step S410 with the diagnosis identifier indicating that the first condition is not met. If the first condition (condition 1) is met, the controller 14 determines whether both conditions 2 and 3 are met in step S420. If conditions 2 and 3 are not met, the controller 14 can determine whether condition 2 is met in set S430. If condition 2 is not met, the controller 14 can determine whether condition 3 is met in step S440, if condition 3 is not met, the controller 14 can indicate that condition 1 is met in step S450. Turning back to S430, if condition 2 is met the controller 14 can determine whether condition 4 is met in step S460. If condition 4 is not met the controller 14 can indicate that conditions 1 and 2 were met in step S470. If condition 4 is met, the controller 14 can determine whether condition 5 is met in step S480. If condition 5 is not met, the controller 14 can determine that condition 4 has been met in step S490. Turning back to step S440, if condition 3 is met, the controller 14 can determine whether condition 4 is met is step S500. If condition 4 is not met, the controller 14 can indicate that conditions 1 and 3 have been met in step S510. If condition 4 is met the controller 14 can determine whether condition 5 is met in step S480. If condition 5 is not met, the controller 14 can determine that condition 4 has been met in step S490. Thus, condition 4 can be met after either condition 2 or condition 3 is met. Furthermore, if both conditions 2 and 3 are met in step S420, the controller 14 can determine whether condition 4 is met is step S520. If condition 4 is not met, the controller 14 can indicate that conditions 2 and 3 have been met in step S530. If condition 4 is met the controller 14 can determine whether condition 5 is met in step S480. If condition 5 is not met, the controller 14 can determine that condition 4 has been met in step S490. As shown in FIG. 4B, since condition 4 can be met through two different diagnostic paths, and it may be uncertain which diagnostic path will be completed first, a split diagnostic status after condition 1 is met and before condition 4 is met is necessary.

The controller 14 can cause each of these diagnosis statuses to be displayed on the display 16. Moreover, each of these diagnosis status can be stored in a storage device 20 in the vehicle diagnostic apparatus 10, or remotely in the cloud or other remote storage device.

Figure 5:
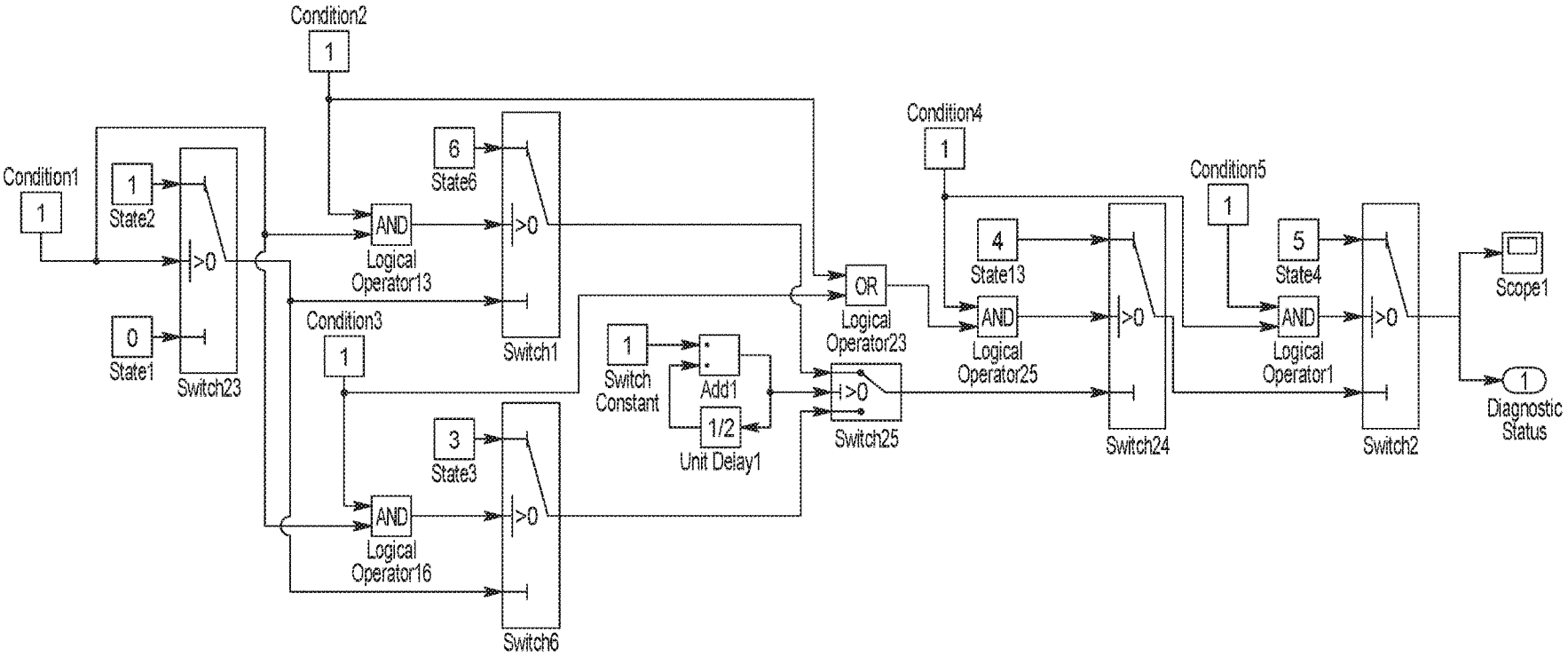
FIG. 5 is a schematic of the multi-threading of FIG. 4 in which condition flags are inputs from conventional models and a new diagnostic status variable is output.

FIG. 5 is a graphical programming environment modeling the procedure illustrated in FIG. 4. FIG. 5 is a schematic in which condition flags are inputs from conventional models and a new diagnostic status variable is output. First, condition 1 is determined. If condition 1 is not met (State 1), the process is terminated with the diagnosis identifier indicating the first condition is not met (Switch 23). If the first condition is met, the controller 14 determines in parallel whether both conditions 2 and 3 (Switch 1 and Switch 6). If conditions 2 and 3 are not met, the controller 14 can determine whether condition 2 is met in met in Switch 1. If condition 2 is not met, the controller 14 can determine whether condition 3 is met in Switch 6. If condition 3 is not met, the controller 14 can indicate that condition 1 has been met. If condition 2 has been met the controller 14 switches Switch 25 for condition 2 and can determine whether condition 4 is met in Switch 24. If condition 4 is not met the controller 14 can indicate that conditions 1 and 2 were met. If condition 4 is met, the controller 14 can determine whether condition 5 is in Switch 2. If condition 5 is not met, the controller 14 can determine that condition 4 has been met. If condition 5 is met, the apparatus can output the diagnostic status and the Scope 1. Turning back to Switch 6, if condition 3 is met, and condition 2 is not met in Switch 1, the controller 14 can switch Switch 25 for condition 3 and can determine whether condition 4 is met in Switch 24. If condition 4 is not met the controller 14 can indicate that conditions 1 and 3 were met. If condition 4 is met, the controller 14 can determine whether condition 5 is in Switch 2. If condition 5 is not met, the controller 14 can determine that condition 4 has been met. If condition 5 is met, the apparatus can output the diagnostic status and the Scope 1. Thus, condition 4 can be met after either condition 2 or condition 3 is met. Furthermore, if both conditions 2 and 3 are met in, the controller 14 can determine whether condition 4 is Switch 24. If condition 4 is not met the controller 14 can indicate that conditions 2 and 3 were met. If condition 4 is met, the controller 14 can determine whether condition 5 is in Switch 2. If condition 5 is not met, the controller 14 can determine that condition 4 has been met. If condition 5 is met, the apparatus can output the diagnostic status and the Scope 1.

Figure 6:
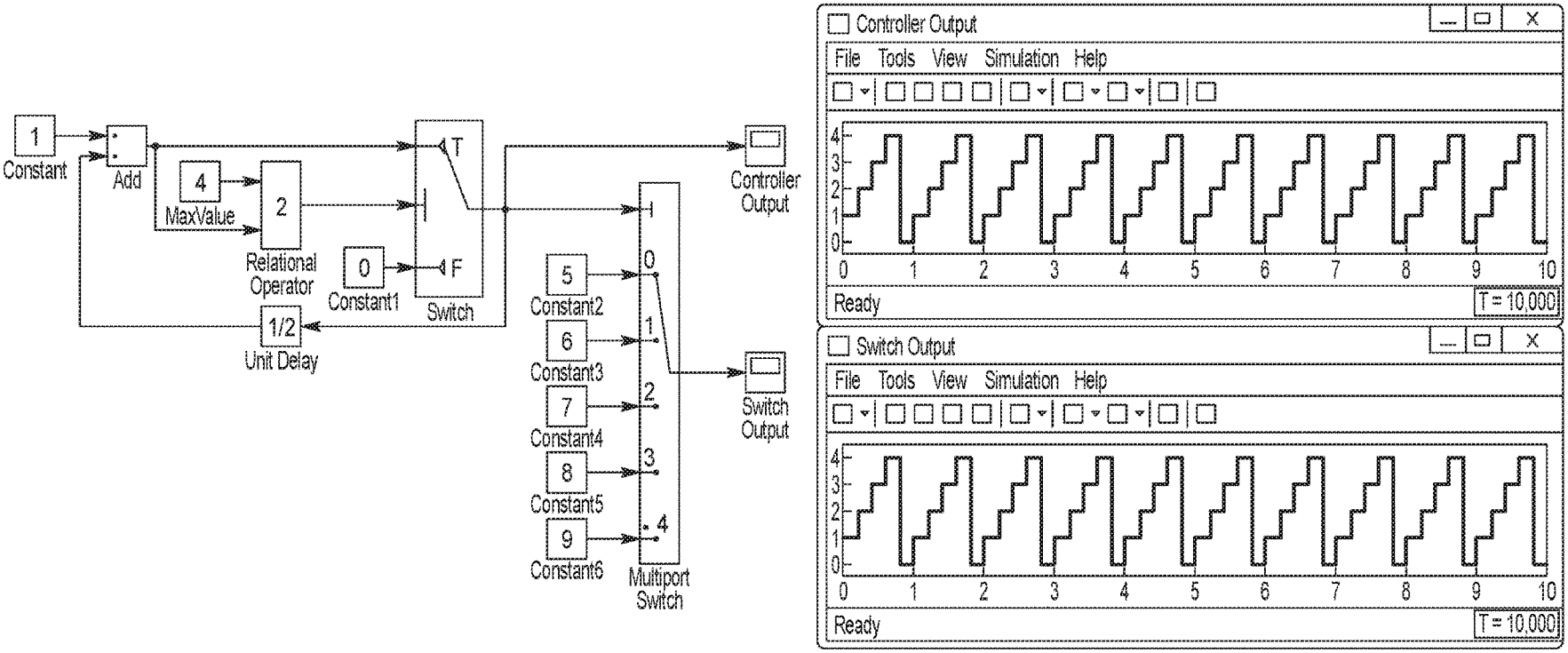
FIG. 6 illustrates model and outputs of how the multi-thread diagnostic accommodates a plurality of diagnostic paths when OR blocks have more than two inputs.

FIG. 6 illustrates outputs how the multi-thread diagnostic can accommodate as many diagnostic paths as needed in cases where OR blocks have more than two inputs. The multi-threading method is capable of simultaneously informing the user of the status of multiple fault paths whenever relevant.

As can be understood, the present invention can be easily standardized, since US have 256 different statuses (0-255), and will fit the needs of any monitor, even if the monitor is the most complex one, such as an EVAP monitor.

This method has minimized impact on RAM/ROM, since only one U8 RAM parameter is needed for each monitor with the embodiments discussed herein, RAM/ROM space can be saved when compared to conventional bit-mapping methods. For example, even in situations in which the OBD system has 1000 OBD monitors, 1 KB extra RAM space will be sufficient to perform the process discussed herein for each monitor.

Furthermore, the embodiments described herein have increased flexibility, since the number of statuses is no longer bounded by the number of bits. Accordingly, the designer can easily change the OBD monitor and re-map the status without incurring dramatic changes in the RAM space. For example, with conventional methods, if U16 is mapped to 16 conditions, and if the designer wants to add an additional condition, the U16 must be deleted and a U32 parameter added. In certain circumstances such an option is not possible. The embodiments described herein can accomplish this task, since it is easy to adjust.

The multi-threading embodiment can simultaneously inform the user of the status of multiple fault paths whenever relevant.

The monitors are conventional components that are well known in the art. Since monitors are well known in the art, these structures will not be discussed or illustrated in detail herein. Rather, it will be apparent to those skilled in the art from this disclosure that the components can be any type of structure and/or programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vehicle diagnostic apparatus, comprising:

a receiver configured to receive information from a vehicle monitor including a plurality of enabling conditions;

an electronic controller configured to receive the information from the receiver and based on the information, determine a status of the monitor, and output the status in only an 8 bit format based on the information received from the vehicle monitor, at least two of the bits in the 8 bit format indicating a predetermined status of the vehicle monitor and at least one bit in the 8 bit format corresponds to a predetermined threshold of a parameter of the vehicle, and the electronic controller configured to determine the status of the plurality of enabling conditions, including outputting in the 8 bit format that at least one enabling condition of the plurality of enabling conditions has been met and at least one condition plurality of enabling conditions has not been met; and a display configured to display the output in only the 8 bit format.

2. The apparatus according to claim 1, wherein the receiver is configured to receive information from a plurality of vehicle monitors, and the electronic controller configured to determine a status for each of the plurality of vehicle monitors, and output the status for each of the plurality of vehicle monitors in the 8 bit format.

3. The apparatus according to claim 1, wherein based on the plurality of enabling conditions, the controller is configured to perform at least one test on the monitor and output results of the test in the 8 bit format.

4. The apparatus according to claim 3, wherein the at least one test includes two tests.

5. The apparatus according to claim 1, wherein the receiver is configured to receive information from the monitor in real time.

6. A method of diagnosing a vehicle monitor, comprising:

receiving information, via a receiver, from the vehicle monitor, the information including a plurality of enabling conditions;

receiving, via an electronic controller, the information from the receiver;

determining, via anthe electronic controller, a status of the vehicle monitor, including the status of the plurality of enabling conditions and based on the information;

outputting, via the electronic controller, the status in only an 8 bit format based on the information received from the vehicle monitor, at least two of the bits in the 8 bit format indicating a predetermined status of the vehicle monitor and at least one bit in the 8 bit format corresponds to a predetermined threshold of a parameter of the vehicle, the status including a status of the plurality of enabling conditions, such that 8 bit format indicates that at least one enabling condition of the plurality of enabling conditions has been met and at least one condition plurality of enabling conditions has not been met; and displaying with a display the output in only the 8 bit format.

7. The method according to claim 6, wherein the receiving information includes receiving information from a plurality of vehicle monitors, the determine the status includes determining the status for each of the plurality of vehicle monitors, and the outputting includes outputting the status for each of the plurality of vehicle monitors in the 8 bit format.

8. The method according to claim 6, further comprising based on the plurality of enabling conditions, performing, via the electronic controller, at least one test on the monitor and outputting results of the test in the 8 bit format.

9. The method according to claim 8, wherein the at least one test includes two tests.

10. The method according to claim 6, wherein the receiving information includes receiving information in real time.

* * * * *